US005409132A

United States Patent [19]

Kooijmans et al.

[11] Patent Number: 5,409,132

[45] Date of Patent: Apr. 25, 1995

[54] TABLET DISPENSER

[75] Inventors: Kees Kooijmans; Alfred H. Van Elk, both of Delft, Netherlands

[73] Assignee: Duphar International Research B.V., Weesp, Netherlands

[21] Appl. No.: 269,954

[22] Filed: Jun. 30, 1994

Related U.S. Application Data

[63] Continuation of Ser. No. 82,478, Jun. 28, 1993, abandoned.

[30] Foreign Application Priority Data

Jul. 1, 1992 [EP] European Pat. Off. ..... 92201959

[51] Int. Cl.[6] ..... G07F 11/54

[52] U.S. Cl. ..... 221/86; 221/89; 221/121; 221/155; 221/185; 221/196; 221/197; 221/287

[58] Field of Search ..... 221/25, 79, 80, 81, 221/82, 83, 86, 89, 121, 151, 152, 154, 155, 185, 194, 196, 197, 287

[56] References Cited

U.S. PATENT DOCUMENTS

| | | | |
|---|---|---|---|
| 2,828,005 | 3/1958 | Ricke | 221/89 |
| 3,085,679 | 4/1963 | Burrell | 221/89 |
| 3,297,198 | 1/1967 | Wright | 221/82 X |
| 3,557,747 | 1/1971 | Rigney et al. | 221/86 X |
| 3,870,192 | 3/1975 | Haley | 221/154 X |
| 3,984,031 | 10/1976 | Thompson | 221/82 |
| 4,165,709 | 8/1979 | Studer | 221/86 X |
| 4,555,044 | 11/1985 | Pearo | 221/82 X |
| 4,646,936 | 3/1987 | Frazier et al. | 221/86 X |
| 4,667,845 | 5/1987 | Frazier et al. | 221/87 X |
| 4,915,256 | 4/1990 | Tump | 221/82 X |

FOREIGN PATENT DOCUMENTS

| | | | |
|---|---|---|---|
| 8301606 | 5/1983 | WIPO | 221/155 X |

*Primary Examiner*—Cheryl L. Gastineau
*Assistant Examiner*—Dean A. Reichard
*Attorney, Agent, or Firm*—Stevens, Davis, Miller & Mosher

[57] ABSTRACT

The invention relates to a tablet dispenser, including a dispenser housing, a replaceable tablet package to be accommodated in the housing, an adjustable periodicity indicator and a single tablet dispensing aperture in the dispenser cover. The tablet package includes a cover, rotatably connected to the bottom portion of the package and provided with an opening which, upon use of the dispenser, is in alignment with the tablet dispensing aperture. The dispenser further includes a locking device to compel joint rotational movement of periodicity indicator and package bottom portion, and an operating member to effect stepwise rotation of the package bottom portion relative to said package cover.

16 Claims, 4 Drawing Sheets

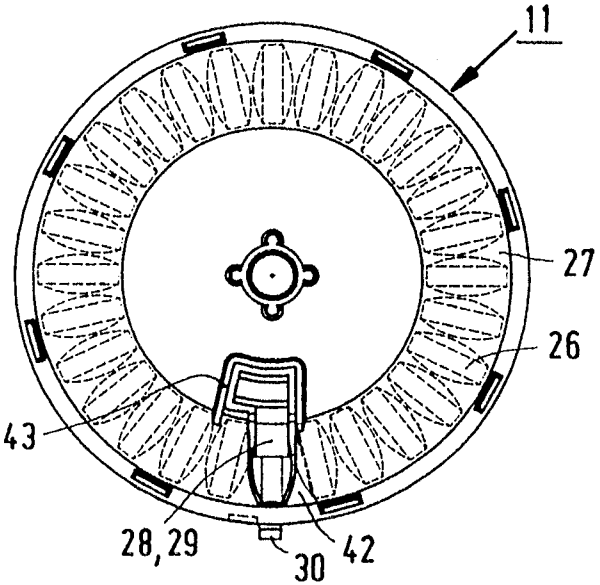
FIG. 4
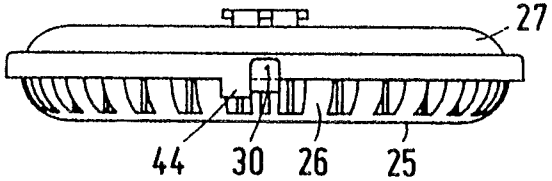
FIG. 5
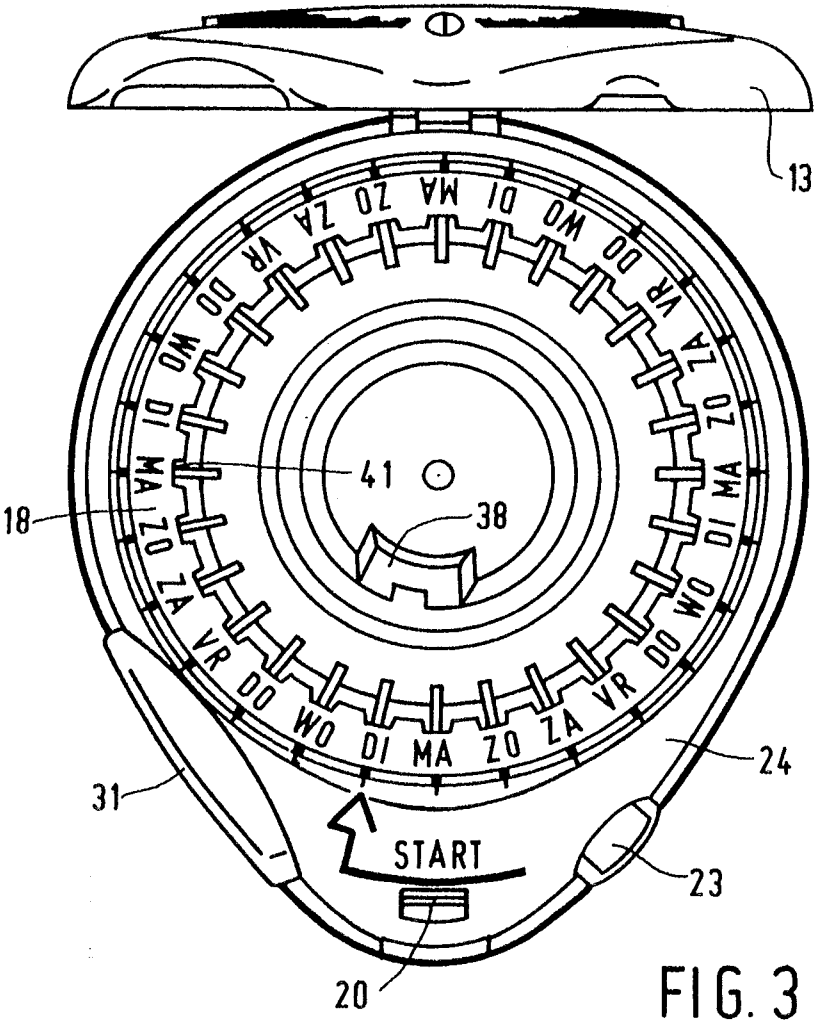
13
24
23
38
41
START
20
31
18
MA ZO ZA VR DO WO DI MA ZO ZA VR DO WO DI MA ZO ZA VR DO WO DI

TABLET DISPENSER

This application is a continuation of application Ser. No. 08/082,478, filed Jun. 28, 1993, abandoned.

The invention related to a tablet dispenser, comprising:

a dispenser housing for accommodating a tablet package, said housing comprising a support, operating means for dispensing the tablets, and a cover reciprocally movable from an opened into a closed position;

a replaceable tablet package, comprising a bottom portion with a plurality of individual tablet compartments, arranged in circular orientation and in mutually spaced relationship;

an adjustable periodicity indicator, rotatable relative to said support; and a single tablet dispensing aperture.

BACKGROUND OF THE INVENTION

Such a tablet dispenser is known, for example from U.S. Pat. Nos. 4,165,709 and 4,646,936. The latter patent discloses a pill dispenser including a periodicity indicator with an improved preset facility compared to the tablet dispenser described in the former patent. Said known tablet dispensers comprise a separate tray, rotatably connected to said support and having a plurality of circular-oriented openings. The tablet package is disposed on said tray in such a manner that the tablets correspond with the openings in the tray. The dispenser housing support provides an aperture for dispensing the tablets, and the tablets are accommodated in collapsible pockets. Upon use, the user opens the dispenser cover and manually rotates the tray relative to the dispenser housing until the particular day, indicated on the periodicity indicator, is in alignment with a pointer. Then the corresponding tablet is pushed downwards out of the collapsible pocket, fracturing a frangible membrane covering the tablet package and passing through its corresponding opening in the tray and through the aperture in the dispenser housing, and can then be collected.

This known tablet dispenser has various disadvantages. The dispenser has a relatively large number of rotating components which makes the dispenser expensive and sensitive to interferences. The operational convenience is unsatisfactory since the dispenser cover should be manually opened for each tablet delivery, the particular day should be adjusted and the tablet should be urged with thumb or finger through a frangible membrane out of its collapsible pocket. The last operation may frequently cause fracture of or damage to the tablets.

SUMMARY OF THE INVENTION

It is the objective of the present invention to provide a tablet dispenser of the type mentioned in the opening paragraph, which dispenser does not exhibit the above disadvantages.

This objective can be achieved by means of a tablet dispenser, comprising a dispenser housing, a replaceable tablet package, an adjustable periodicity indicator and a single tablet dispensing aperture, as defined hereinbefore, which dispenser is characterized according to the present invention in that:

said single tablet dispensing aperture is provided in the dispenser cover; and window means are provided in the dispenser housing for inspecting periodicity indicator and tablet supply;

which dispenser is further characterized according to the present invention in that, upon use of the dispenser:

said tablet package comprises a cover, rotatably connected to the bottom portion and provided with an opening in alignment with the individual tablet compartments upon rotation of said bottom portion relative to said rotatable cover;

said single tablet dispensing aperture is positioned in alignment with the opening in the package cover;

a locking means is provided between periodicity indicator and package bottom portion to compel joint rotational movement of indicator and bottom portion in one direction, in order to keep the periodicity indicator associated with each of the tablet compartments; and said operating means, comprising an operating member which can be manipulated from the outside, effect stepwise rotation of said package bottom portion with said periodicity indicator relative to said package cover and to said dispenser housing, in order to align each tablet compartment with said opening in the package cover and with said aperture in the dispenser cover as each individual compartment passes thereover, in order to allow dispense of the tablets.

The tablet dispenser according to the present invention can easily be used by simply manipulating the operating member. The tablet to be dispensed is thereby released and can be collected by overturning the dispenser. In the tablet dispenser of the invention a separate tray is absent, making the dispenser less complicated. The window means are provided either in the dispenser housing support or in the dispenser cover, through which the relevant day on the periodicity indicator can be inspected, as well as, provided the package bottom portion or the package cover, respectively, is transparent, the supply of tablets present in the tablet compartments. Said locking means between periodicity indicator and package bottom portion may be constituted, in a suitable embodiment, by a combination of a projection and a recess, said recess, provided in one of these dispenser-parts, forming an abutment for said projection, provided on the other. In this manner rotation of the bottom portion effects simultaneous rotation of the, generally annular, periodicity indicator. The operating member, to be manipulated from the outside, permits use of the dispenser without opening the dispenser cover. This also improves the safety of the dispenser and reduces the risk of unintentional tablet release. As opposed to the manual operation of dispensing the tablets from the known dispenser, the mechanical operation of the dispenser of the invention is more reliable and prevents fracture of or damage to the tablets. The dispenser cover should only be opened in case the empty tablet package should be replaced by a filled package. The dispenser cover is preferably hingedly attached to the dispenser housing support and can be closed, preferably against a spring force, e.g. by a clamping, slide lock or snap lock mechanism.

In a favorable embodiment of the tablet dispenser of the present invention, the periodicity indicator can be adjusted prior to use of the dispenser, i.e. can be preset in a starting position. For this purpose, in the opened position of the dispenser cover and prior to accommodating the tablet package into the dispenser housing, the periodicity indicator allows rotation in the same direction as the joint rotational movement of indicator and package bottom portion during use of the dispenser, until the starting position is reached. After adjustment of the periodicity indicator, the tablet package is positioned into the dispenser housing. The tablet package preferably can only be placed into the dispenser housing in one position, to preclude any possibility of errors. In this particular position, periodicity indicator and package bottom portion are interlocked to compel their joint rotational movement in one direction.

In a further favourable embodiment the opening in the tablet package cover is covered by a flap, removable, e.g. by tumbling, upon positioning the package into the dispenser housing and closing the dispenser cover, in order to allow dispense of the tablets through said opening upon use of the dispenser. In order to allow removal of the flap upon positioning the tablet package into the dispenser housing and closing the dispenser cover, a pushing member, e.g. a push pin, may be provided in the dispenser housing, preferably on the inner wall of the dispenser cover, so that closing of said cover results in said flap being opened, in order to allow a tablet to be released.

Preferably the tablet dispenser of the present invention is constructed in such a manner, that a first manipulation of the operating member, after the tablet package has been positioned into the dispenser housing and the dispenser cover has been closed, effects a one-step rotational movement of the tablet package in order to dispose the first tablet in alignment with the opening in the package cover and with the aperture in the dispenser cover. The dispenser is now in a position of use. In this position a first tablet can be collected by the user by simply overturning the dispenser. After dispense of said first tablet, further rotational movement of the tablet package cover is prevented, allowing rotation of the package bottom portion relative to said package cover. Consequently, further manipulation of the operating member effects stepwise rotation of the package bottom portion, associated with the periodicity indicator, relative to the package cover to permit the successive release of the individual tablets.

In connection with certain safety requirements, it may be desirable to construct the tablet dispenser of the present invention in such a manner, that interlocking means are provided between the dispenser housing support and the tablet package, which interlocking means are operative when during the periodicity cycle the dispenser cover is moved from the closed into the opened position, in order to prevent removal of the package from the dispenser housing in this position. Such interlocking means may conveniently comprise a projection provided on the inner wall of the package bottom portion, which cooperates with a suitable fixation auxiliary in the dispenser housing, e.g. a fixation member connected on the dispenser housing support behind which said projection engages.

In a suitable embodiment, said operating means for effecting stepwise rotation of the package bottom portion relative to the dispenser housing comprise a resilient press-button, which can be manipulated from the outside, and interengaging means between said press-button and the package bottom portion, said interengaging means converting an inward movement of the former into a stepwise rotational movement of the latter.

The resiliency of the press-button can easily be obtained by use of a suitable spring. In a favourable embodiment, said interengaging means comprise a catch or lever, which engages with one end the press-button and with its lever arm a cammed outer surface integrated with the annular periodicity indicator, engaging the package bottom portion. If said periodicity indicator and simultaneously therewith said package bottom portion is rotatably moved under the influence of a suitable spring, each inward movement of the press-button effects a stepwise rotational movement of the package bottom portion to bring each individual tablet successively in a condition for dispense. To prevent further rotational movement of the package bottom portion before the tablet, "emerged" by the previous rotational movement, has been dispensed and collected, said "emerged" tablet is retained by a stop boss provided on the tablet package cover.

In a suitable embodiment, an additional indication is present, indicating that the last tablet has been dispensed from the tablet package. In this situation the periodicity indicator cannot rotate further, because, for example, a projection provided on the package bottom portion abuts against said stop boss on the package cover.

To avoid unintentional operation or opening of the dispenser, safety locking means are provided. In a suitable embodiment, the operating means are touch controlled locked, said touch control permitting unlocking of said operating means. In case the operating means comprise a resilient press-button and interengaging means between press-button and package bottom portion, said interengaging means are locked in such a manner, that mere manipulation of the press-button does not effect stepwise rotation of the package bottom portion. Only simultaneous manipulation of the touch control, preferably conveniently operating against a spring resistance, and of the press-button effects unlocking of the operating means and, as a result, rotational movement of the package bottom portion in the dispenser housing. Also the dispenser cover may be safety-locked, if so desired. Suitable locking means comprise, for example, a touch control, preferably the same touch control as used to unlock the operating means. Only upon simultaneously manipulating the touch control, the dispenser cover is unlocked and can be opened.

BRIEF DESCRIPTION OF THE DRAWINGS

The invention will now be described in greater detail with reference to a preferred embodiment which is shown in the drawings, in which:

FIG. 3 is a top view of the FIG. 1 dispenser, in the opened condition and prior to positioning the tablet package;

FIG. 4 shows a top view of the tablet package on the same scale;

FIG. 5 shows a side-view of the FIG. 4 tablet package;

DETAILED DESCRIPTION OF THE INVENTION

Figure 2:
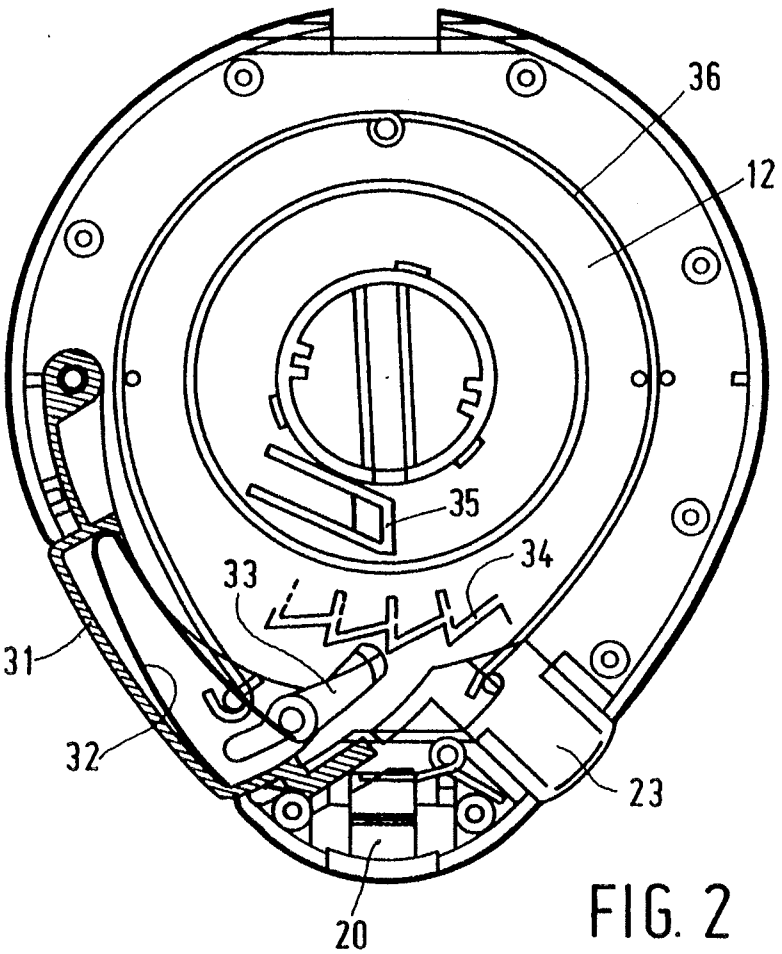
FIG. 2 is a top view of the dispenser support provided with the operating means.
Figure 1:
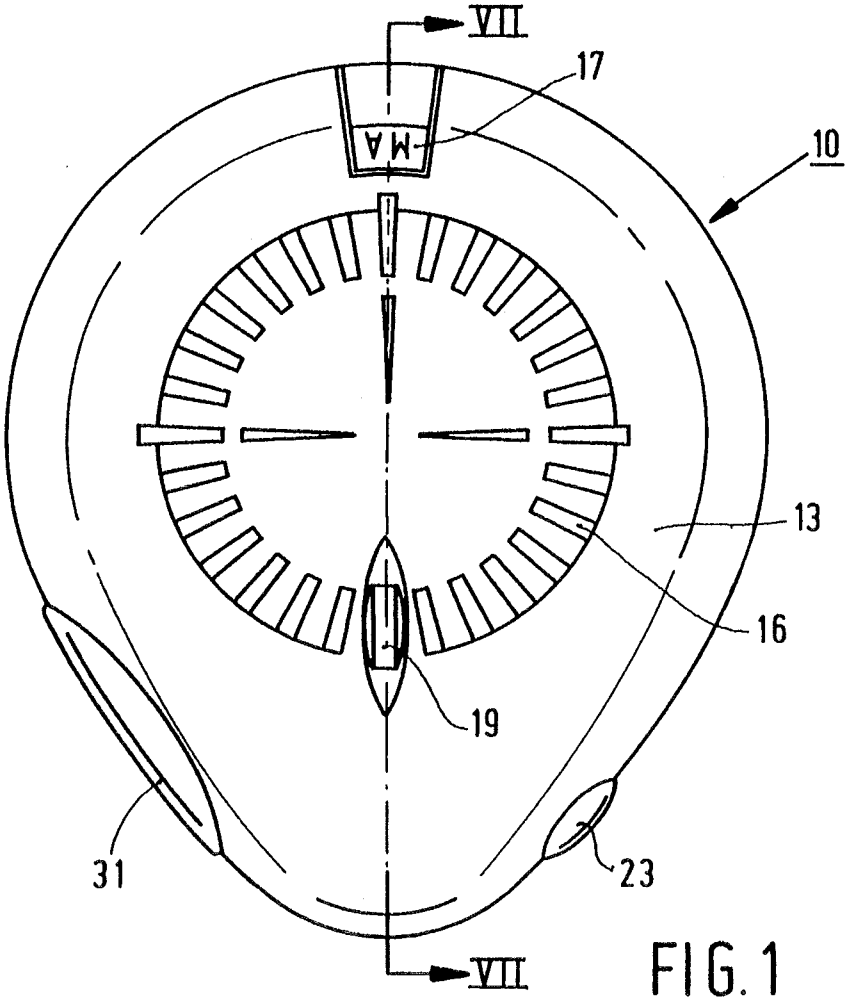
FIG. 1 is a top view of a tablet dispenser according to the invention, in a ready-for-use condition.
Figure 6:
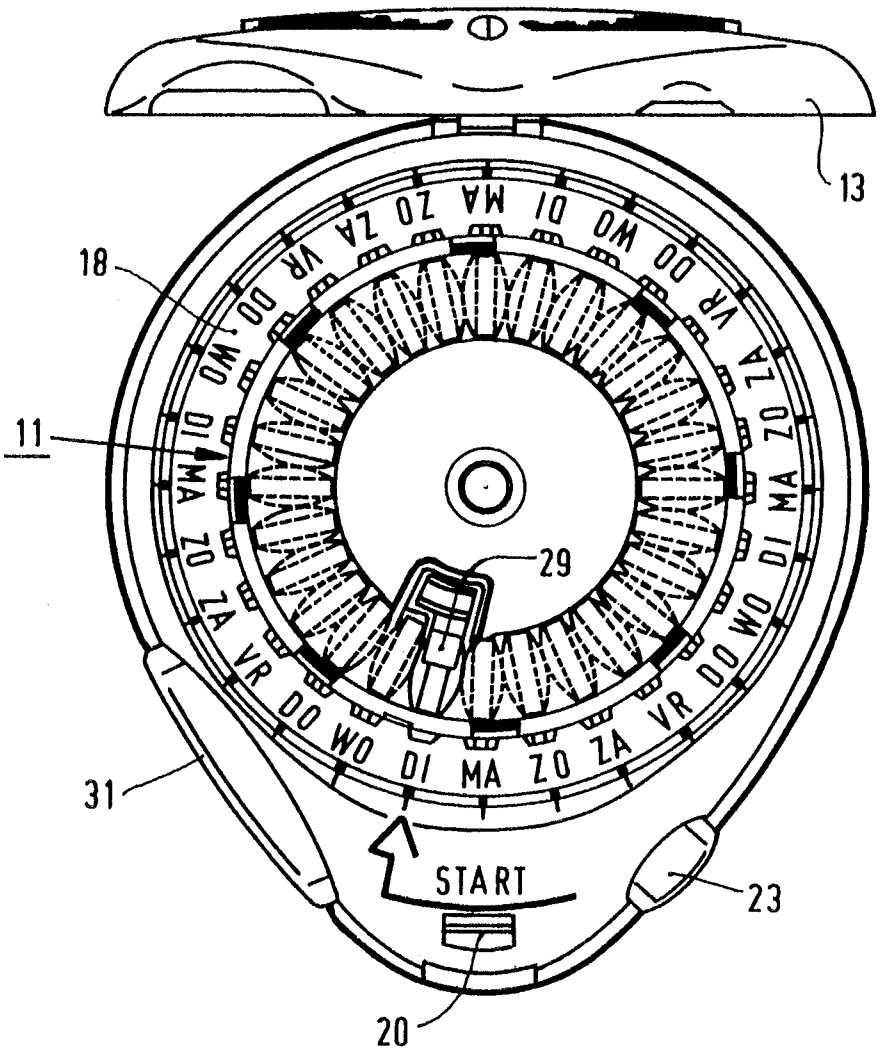
FIG. 6 is the same top view as shown in FIG. 3, after the tablet package of FIG. 4 has been positioned.

The tablet dispenser presented in the Figures comprises a dispenser housing 10 for accommodating a tablet package 11. Said housing comprises a substantially flat support 12 and a cover 13, hingedly attached to the support. The cover, closing against a spring resistance (14, 15), is provided with circular-oriented window means 16 for inspecting the tablet supply in the tablet package. Further the cover comprises a window 17 for inspecting the relevant day on the annular periodicity indicator 18, and a single tablet dispensing aperture 19. The window means are manufactured from a transparent material. A slide lock 20, acting against a spring (21) power, is provided in the dispenser support 12 and locks the cover via a locking catch 22. A touch control 23 is present as a safety lock, permitting opening of the cover by unlocking said safety lock.

Figure 7:
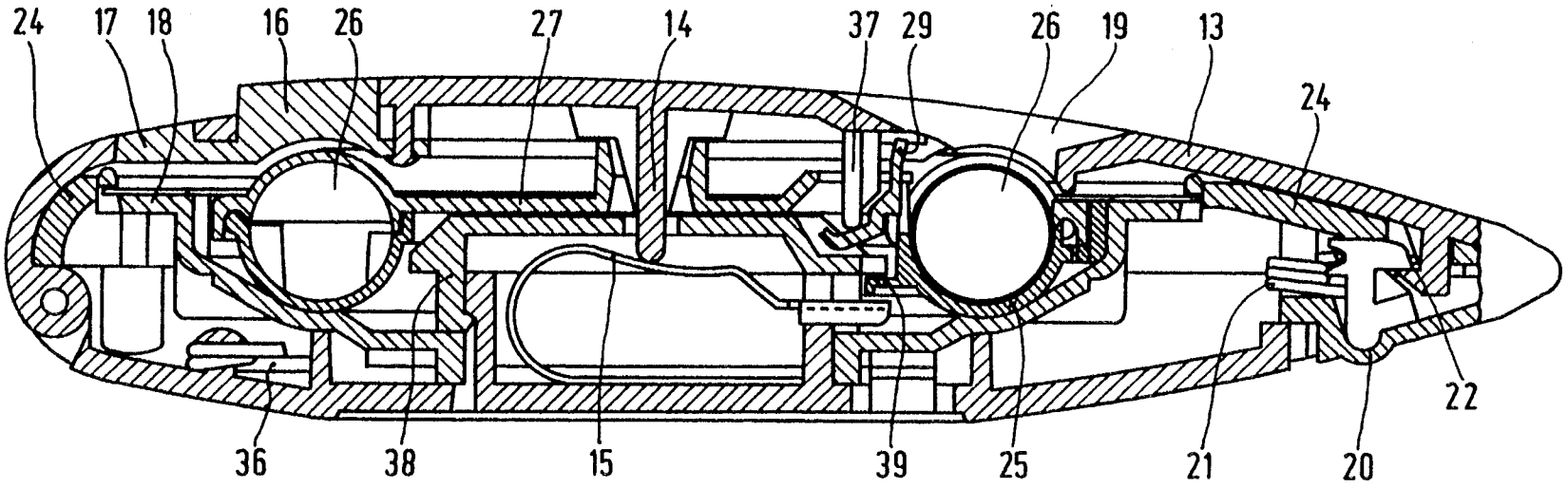
FIG. 7 shows a cross-sectional view of the same tablet dispenser on an enlarged scale, taken on the line VII—VII in FIG. 1.

The interior portion of the operating means is covered by a covering disk (tray) 24, mounted within the dispenser support and provided with a "start" indication and an arrow. The periodicity indicator 18 can be rotated anti-clockwise to preset the indicator in the starting position, i.e. to indicate a specific day, e.g a Tuesday (DI) as the starting day. After adjustment of the periodicity indicator, the tablet package 11 is positioned into the dispenser housing. The tablet package comprises a bottom portion 25 having a plurality of individual tablet compartments 26, arranged in circular orientation and in mutually spaced relationship. A cover 27 of a transparent material, preferably manufactured of a transparent polypropylene, is rotatably connected to the bottom portion. In the package cover 27 an opening 28 is recessed in alignment with the individual tablet compartments. This opening is covered by a flap 29, which can be removed by tumbling to allow the tablets to be dispensed via the opening upon use of the dispenser. The tablet package can be placed into the dispenser housing in only one specific position (see FIG. 7), in which position a projection or positioning pawl 39 on the tablet bottom portion engages behind a fixation insert 38, connected on the dispenser housing support. An outwardly extending projection 30 on the outer edge of the tablet bottom portion engages a corresponding indent, forming part of a inwardly directed notched ring 41, integrated with the annular periodicity indicator 18. In this manner a locking means is provided between periodicity indicator and package bottom portion to compel joint rotational movement of indicator and bottom portion.

The operating means comprise a press-button 31 which can be pushed inwards against a spring (32) force. The inward movement of the press-button is converted into a one-step rotational movement of the package bottom portion by means of interengaging means. These interengaging means encompass a lever 33, engaging via said spring 32 the press-button and engaging with its lever arm a cammed (34) outer surface integrated with the periodicity indicator 18. The package bottom portion is rotatably moved under the influence of spring 35. Each inward movement of the press-button engages the lever arm with said cammed outer surface, effecting a stepwise rotational movement of periodicity indicator plus associated bottom portion. To prevent unintentional operation of the dispenser, i.e. unintentional rotational movement of the tablet bottom portion, safety locking means are provided. The above touch control 23 is provided as a safety lock also for this purpose. Manipulation of said touch control, operating against a spring 36, effects unlocking of the press-button to allow said press-button to be moved inwards.

The operation of the tablet dispenser, shown in the Figures, is explained below, more in particular with reference to FIGS. 3, 4, 6 and 7. After adjusting the periodicity indicator (see FIG. 3), the tablet package is positioned into the dispenser housing in such a manner that its positioning pawl 39 engages behind insert 38 [pawl 39 can reach this position via an indent in this insert]; simultaneously its projection 30 engages one of the indents of the periodicity indicator's notched ring 41. In this manner periodicity indicator and package bottom portion are interlocked and the FIG. 6 situation has been reached. After positioning the tablet package into the dispenser housing, dispenser cover 13 is closed, resulting in the FIG. 7 situation. Upon closing the dispenser cover, locking catch 22 engages behind a protruding portion of slide lock 20, thus providing a locking means for said cover. A push pin 37, provided on the inner wall of the dispenser cover, removes flap 29 by tumbling it. A first manipulation of press-button 31 together with touch control 23 results in a first rotational step of the tablet package together with the periodicity indicator in order to bring opening 28 in the package cover into alignment with aperture 19 in the dispenser cover. In this position, wherein further rotational movement of the package cover is prevented by the opening's side wall 43 abutting against push pin 37, a first tablet is exposed and can be collected by the user by simply overturning the dispenser. The "emerged" tablet, by engaging an inwardly directed ridge 42 on the package cover, prevents further rotational movement of the package bottom portion before said tablet has been dispensed.

When during the periodicity cycle the dispenser cover is opened by simultaneously pushing inwards the touch control 23 (safety lock) and moving the slide lock 20, safety means become activated. The dispenser cover is pushed open under the influence of spring 15, engaging pin 14, provided on the inner wall of the cover. In this position, the positioning pawl 39 of the package bottom portion is locked against fixation insert 38. As a result, removal of the tablet package from the dispenser housing is prevented.

The dispenser comprises an additional indication, that the last tablet has been dispensed from the tablet package and that said package should be replaced by a filled one. Such an indication can conveniently be provided by projections (30,44), provided on package bottom portion and package cover, respectively, forming a mutual abutment in this condition. The mutual abutment of these projections causes concurrent locking of lever 33. To prevent damage to the operating means, these means are preferably protected in this position. Such a protection may conveniently comprise a projection in the form of a pin provided on lever 33, which in sliding cooperation with a matching recess in the inward portion of press-button 31 permits the inward movement of said press-button without exerting force on locked lever 33 in this condition of the dispenser.

The same protection becomes operative in case the press-button is manipulated before the previously "emerged" tablet has been dispensed (see above). In this situation said protection not only prevents damage to the operating means, but also prevents both damage to the "emerged" tablet and derangement of the adjusted periodicity.

We claim:

1. A tablet dispenser, comprising:

a dispenser housing for accommodating a tablet package, said housing comprising a support, operating means for dispensing the tablets, and a cover reciprocally movable from an opened into a closed position;

a replaceable tablet package, comprising a bottom portion with a plurality of individual tablet compartments, arranged in circular orientation and in mutually spaced relationship;

an adjustable periodicity indicator coaxially located with respect to said tablet package, rotatable relative to said support; and a single tablet dispensing aperture;

said dispenser being characterized in that:

said single tablet dispensing aperture is provided in the dispenser cover; and window means are provided in the dispenser housing for inspecting the periodicity indicator and tablet supply;

said dispenser being further characterized in that, upon use of the dispenser:

said tablet package comprises a cover, rotatably connected to the bottom portion and provided with an opening in alignment with the individual tablet compartments upon rotation of said bottom portion relative to said rotatable cover;

said single tablet dispensing aperture is positioned in alignment with the opening in the package cover;

a locking means is provided between the periodicity indicator and package bottom portion to compel joint rotational movement of the periodicity indicator and bottom portion in one direction, in order to keep the periodicity indicator associated with each of the tablet compartments; and said operating means, comprising an operating member which can be manipulated frown outside of the dispenser housing, effect stepwise rotation of said package bottom portion with said periodicity indicator relative to said package cover and to said dispenser housing, in order to align each tablet compartment with said opening in the package cover and with said aperture in the dispenser cover as each individual compartment passes thereover, in order to allow dispersing the tablets.

2. A tablet dispenser as claimed in claim 1, characterized in that the dispenser comprises a provision so that in the opened position of the dispenser cover prior to accommodating the tablet package into the dispenser, the periodicity indicator allows rotation in the same direction as the joint rotational movement of said indicator and said package bottom portion during use of the dispenser, to preset said indicator in a starting position.

3. A tablet dispenser as claimed in claim 1, characterized in that the opening in the tablet package cover is covered by a flap, removable upon positioning the package into the dispenser housing and closing the dispenser cover, in order to allow dispense of the tablets through said opening upon use of the dispenser.

4. A tablet dispenser as claimed in claim 1, characterized in that interlocking means are provided between the dispenser housing support and the tablet package, which interlocking means become operative when during the periodicity cycle the dispenser cover is moved from the closed into the opened position, in order to prevent removal of the package from the dispenser housing in this position.

5. A tablet dispenser as claimed in claim 1, characterized in that the operating means, for effecting stepwise rotation of the package bottom portion relative to the dispenser housing, comprise a resilient press-button, which can be manipulated from the outside, and interengaging means between said press-button and the package bottom portion, said interengaging means converting an inward movement of the former into a rotational movement of the latter.

6. A tablet dispenser as claimed in claim 5, characterized in that said operating means are safety touch controlled locked, said touch control permitting unlocking of said operating means.

7. A tablet dispenser as claimed in claim 5, characterized in that said dispenser cover is provided with a safety locking means, unlocking of which means permitting opening of said dispenser cover.

8. A tablet dispenser as claimed in claim 6, characterized in that said dispenser cover is provided with a safety locking means, unlocking of which means permitting opening of said dispenser cover.

9. A tablet package for a tablet dispenser as claimed in claim 1, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

10. A tablet package for a tablet dispenser as claimed in claim 2, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

11. A tablet package for a tablet dispenser as claimed in claim 3, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

12. A tablet package for a tablet dispenser as claimed in claim 4, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

13. A tablet package for a tablet dispenser as claimed in claim 5, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

14. A tablet package for a tablet dispenser as claimed in claim 6, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

15. A tablet package for a tablet dispenser as claimed in claim 7, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

16. A tablet package for a tablet dispenser as claimed in claim 8, said tablet package comprising a bottom portion with a plurality of individual tablet compartments, arranged in circular orientation and in mutually spaced relationship; which tablet package is characterized in that it comprises a cover, rotatably connected to the bottom portion and provided with an opening in alignment with the individual tablet compartments upon rotation of said bottom portion relative to said rotatable cover.

* * * * *